US009591412B2

(12) United States Patent
Neumeyer et al.

(10) Patent No.: US 9,591,412 B2
(45) Date of Patent: Mar. 7, 2017

(54) DEVICES AND METHODS FOR COLLECTING ACOUSTIC DATA

(75) Inventors: Frederick Charles Neumeyer, Austin, TX (US); David Matthew Landry, Austin, TX (US); Samir Ibrahim, Silver Spring, MD (US); John Michael Page Knox, Austin, TX (US); John Gray Bartkowiak, Stromness (GB)

(73) Assignee: III Holdings 4, LLC, Wilmington, DE (US)

( * ) Notice: Subject to any disclaimer, the term of this patent is extended or adjusted under 35 U.S.C. 154(b) by 530 days.

(21) Appl. No.: 13/090,778

(22) Filed: Apr. 20, 2011

(65) Prior Publication Data

US 2011/0280422 A1 Nov. 17, 2011

Related U.S. Application Data

(60) Provisional application No. 61/345,417, filed on May 17, 2010.

(51) Int. Cl.
*H04R 25/00* (2006.01)

(52) U.S. Cl.
CPC ..... *H04R 25/554* (2013.01); *H04R 25/558* (2013.01); *H04R 2225/39* (2013.01); *H04R 2225/55* (2013.01); *H04R 2460/07* (2013.01)

(58) Field of Classification Search
CPC ..... H04R 25/70; H04R 25/30
See application file for complete search history.

(56) References Cited

U.S. PATENT DOCUMENTS

| | | | | |
|---|---|---|---|---|
| 4,995,011 | A | 2/1991 | Spiesberger | |
| 5,691,957 | A | 11/1997 | Spiesberger | |
| 6,944,474 | B2 * | 9/2005 | Rader et al. | 455/550.1 |
| 7,613,314 | B2 * | 11/2009 | Camp, Jr. | 381/315 |
| 2004/0078587 | A1 * | 4/2004 | Brackett et al. | 713/200 |
| 2006/0182294 | A1 * | 8/2006 | Grasbon et al. | 381/312 |
| 2007/0026858 | A1 * | 2/2007 | Mizukoshi | H04W 88/06 455/426.1 |
| 2008/0159547 | A1 * | 7/2008 | Schuler | G01H 3/14 381/56 |
| 2008/0222021 | A1 * | 9/2008 | Stanforth et al. | 705/37 |
| 2010/0119093 | A1 * | 5/2010 | Uzuanis et al. | 381/312 |
| 2010/0142725 | A1 * | 6/2010 | Goldstein et al. | 381/92 |
| 2010/0284556 | A1 * | 11/2010 | Young | H04R 25/558 381/314 |

* cited by examiner

*Primary Examiner* — Duc Nguyen
*Assistant Examiner* — Taunya McCarty
(74) *Attorney, Agent, or Firm* — Perkins Coie LLP

(57) ABSTRACT

A device includes a network interface to communicate with a communication network and a microphone to convert sounds into an electrical signal. The device further includes a processor coupled to the microphone and the network interface. The processor is configured to process the electrical signal to generate acoustic data based on the electrical signal and to provide the acoustic data to the network interface for transmission to a data storage device.

21 Claims, 3 Drawing Sheets

DEVICES AND METHODS FOR COLLECTING ACOUSTIC DATA

CROSS REFERENCE TO RELATED APPLICATION(S)

This application is a non-provisional of and claims priority to U.S. Provisional patent application No. 61/345,417, entitled "SYSTEM FOR THE COLLECTION OF ACOUSTIC RELATED DATA," and filed on May 17, 2010, which is incorporated herein by reference in its entirety.

FIELD

This disclosure relates generally to acoustic data collection systems, and more particularly to devices, systems and methods for collecting acoustic data.

BACKGROUND

The primary cause of hearing loss is extended exposure to high decibel levels and damaging sound. The hearing loss an individual suffers is directly related to the levels or type of sound to which he/she is exposed. The uniqueness of the sounds an individual encounters results in uniqueness in the level or frequencies of their hearing loss. Deficiencies tend to vary across the range of audible sound with many individuals having hearing impairment with respect to only particular acoustic frequencies.

Hearing aids are programmed by a hearing health professional to compensate for the individual's hearing loss. During the fitting and programming process, the hearing health professional typically takes measurements using calibrated and specialized equipment to assess an individual's hearing capabilities in a variety of simulated sound environments, and then adjusts the hearing aid based on the calibrated measurements. In some instances, the hearing health professional may create multiple hearing profiles for the user for use in different sound environments.

However, such measurements taken by the hearing health professional may not accurately reflect the individual's actual acoustic environment. The health professional may ask questions about the individual's typical environment, but such questions only provide rough estimates as to the actual noise exposure. If the hearing health professional had access to data related to the actual acoustic environment of the individual, he/she could tune the hearing aid more precisely, providing a more enjoyable hearing experience.

While some systems exist for collecting acoustic data, such acoustic collection systems are typically limited to discrete sound environments. One example of such a collection system is an industrial process control system that uses acoustic sensors for monitoring various process parameters. Such systems are often calibrated to detect selected changes in acoustic signals within a single physical environment that does not typically change rapidly.

Another example of such a collection system includes a set of receivers arranged to monitor a limited area. One such collection system can be used to monitor oceanic environmental parameters, such as wind speeds, for example. Unfortunately, the area that can be reliably monitored in this way is relatively small. Though large areas may be monitored by spacing such sensors far apart, such spacing results in few data points.

BRIEF DESCRIPTION OF THE DRAWINGS

In the following description, the use of the same reference numerals in different drawings indicates similar or identical items.

DETAILED DESCRIPTION OF ILLUSTRATIVE EMBODIMENTS

Embodiments of devices, systems and methods for collecting acoustic data are described below, which can be incorporated into various every day devices, such as cell phones, other hand-held computing devices, personal computers, music players, and the like. As used herein, the term "computing device" refers to any electronic device that includes a processor configured to execute instructions. To the extent that a computing device is configured to collect acoustic samples, such a device may include or be connected to a microphone for converting sounds into electrical signals. Such computing devices can be configured to sample acoustic data (such as frequency and amplitude data associated with a particular date and time and at a particular location) and to provide such samples to a data storage device, which can be used to store the acoustic samples. Such samples may be used by hearing health professionals to more accurately program hearing aids for different acoustic environments.

Figure 1:
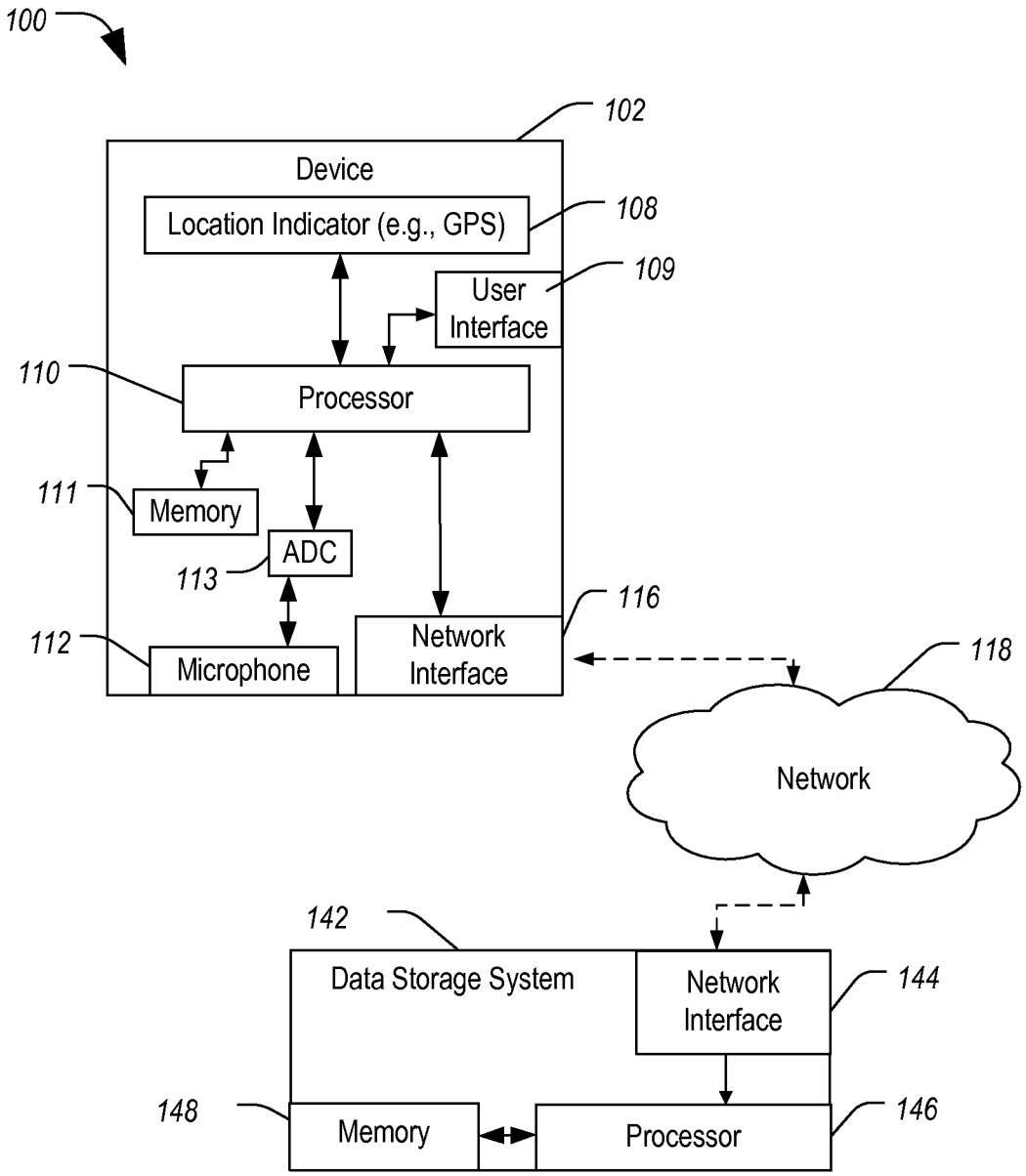
FIG. 1 is a block diagram of an embodiment of a system for collecting acoustic data.

FIG. 1 is a block diagram of an embodiment of a system 100 for collecting acoustic data. System 100 includes a plurality of devices, such as device 102, adapted to communicate with a data storage system 142 through a network 118, such as a cellular network, a public switched telephone network, or a computing network, such as the Internet. Device 102 is a computing device that includes at least a processor 110 capable of executing instructions. Processor 110 is connected to a user interface 109 for displaying information and for receiving user input. In an example, the user interface 109 is a touch screen interface. Processor 110 is also connected to a memory 111, which stores instructions executable by processor 110. Further, processor is connected to an output of an analog-to-digital converter (ADC) 113, which has an input connected to an output of a microphone 112. Microphone 112 converts sound into an electrical signal and provides the electrical signal to ADC 113, which digitizes the electrical signal to produce a sound sample and to provide the sound sample to processor 110. Processor 110 is also connected to a network interface 116 adapted to communicate with network 118 to provide acoustic data to data storage system 142. Network interface 116 can be a network interface circuit or a radio frequency transceiver circuit configured to communicatively connect to network 118 through a wired or wireless connection. Device 102 may further include a location indicator 108, such as a GPS (global positioning system) circuit, for collecting and communicating location data to processor 110 based on a location associated with the device 102. In some instances, processor 110 combines the location data from location indicator 108 with acoustic information derived from the sound sample to produce the acoustic data. The acoustic data may also include a time stamp. Device 102 may be a hearing aid, a cell phone, another data processing device, and/or a system including any combination thereof.

Data storage system 142 is a remote device configured to collect and process acoustic data received from device 102. Data storage system 142 is configured to receive data from any device capable of communicating through network 118. Data storage system 142 includes a network interface 144 communicatively connected to network 118, a processor 146 connected to network interface 144, and a memory 148 connected to processor 146. In some embodiments, data storage system 142 can include multiple computing devices, and memory 148 may be distributed across multiple devices, such as within a server farm.

In one embodiment, device 102 receives a trigger to initiate collection of a sample of the acoustic environment. In one instance, the trigger is received from data storage system 142 through network interface 144. In another instance, the trigger is generated internally based on a periodic function defined in instructions executed by processor 110. In still another instance, the trigger is initiated by a user via the user interface 109. In one example, device 102 may receive a trigger every day or every hour, or may receive an instruction to continuously collect samples until instructed otherwise. The trigger may also include instructions executable by processor 110 to collect samples over a specified period of time. In a particular example, the specified period of time may be related to a time of day during which a user has experienced particular difficulties in hearing determined by the health professional during discussions with the user.

In another embodiment, the trigger may be initiated by a user through interaction with user interface 109. In one possible example, device 102 is a hearing aid system, and the trigger can be generated whenever the user selects a new hearing aid configuration or modifies a hearing aid setting. In a particular example, the hearing aid system includes a hearing aid configured to communicate with a data processing device, such as a cell phone, which is represented by device 102.

Regardless of its source, once a trigger is received by device 102, processor 110 controls microphone 112 to sample the user's acoustic environment in response to receiving the trigger. Microphone 112 converts sounds into a continuous electric signal and may include or be connected to an analog-to-digital converter (ADC) 113 to convert the electrical signals into samples, which are provided to processor 110. Processor 110 processes the samples to produce acoustic data, which are sent to data storage system 142 through network 118. Each sample includes amplitude and frequency data, time data, and location data from location indicator 108 to indicate where and when the acoustic data was collected.

In some instances, processor 110 may be configured to strip identifying data from the acoustic data and to encrypt the data to produce anonymous-encrypted data in order to protect the privacy of the user, particularly the user's location, when the device (such as a hearing aid) provides the acoustic data. In some instances, an opt-in function may be selected by the user to elect to provide such information and to enable device 102 to communicate such data to data storage system 142.

The acoustic data may take various forms including but not limited to the sound sample, data generated from the sound sample, or a combination of the above. For example the acoustic data may include frequencies, decibel levels at each frequency, and amplitudes associated with the frequencies. In one embodiment, device 102 is a hearing aid system and the acoustic data may also include data related to hearing aid configuration (or configuration data related to device 102). In an example, the acoustic data represents the frequency and amplitude data from one or more discrete samples, such that the samples are insufficient to reproduce the audio content.

In some embodiments, processor 110 may include location data with the acoustic data. Location data, such as a GPS position, or a longitude and latitude associated with a particular acoustic sample are collected from location indicator 108 at the time microphone 112 collects the acoustic data and is combined with the acoustic data in a data packet by processor 110. For example, device 102 may include Global Positioning System (GPS) circuitry configured to determine a GPS location of device 102 when the sample is taken. The acoustic data may also include a time stamp indicating the time when the sample was taken and/or the acoustic data was generated. Processor 110 packages the acoustic data for transmission to data storage system 142. The acoustic data may be formatted and encoded for transmission through network 118 according to the appropriate transmission protocols for network 118.

Data storage system 142 is configured to receive acoustic data from a plurality of devices, such as device 102. Processor 146 may organize the acoustic data based on a number of filters to produce sound-related records for storage in memory 148. In one instance, the records may be stored in a database, which may be used by hearing health professionals to produce hearing aid profiles. Further, such records may be accessible in a generic form for other applications, such as for access by a software application to generate an acoustic map, which may be overlaid on a geographic map.

While FIG. 1 describes one possible embodiment of device 102, other systems may include additional circuitry or devices. One possible embodiment of device 102 that is configured to communicate with a hearing aid and with data storage system 142 is described below with respect to FIG. 2.

Figure 2:
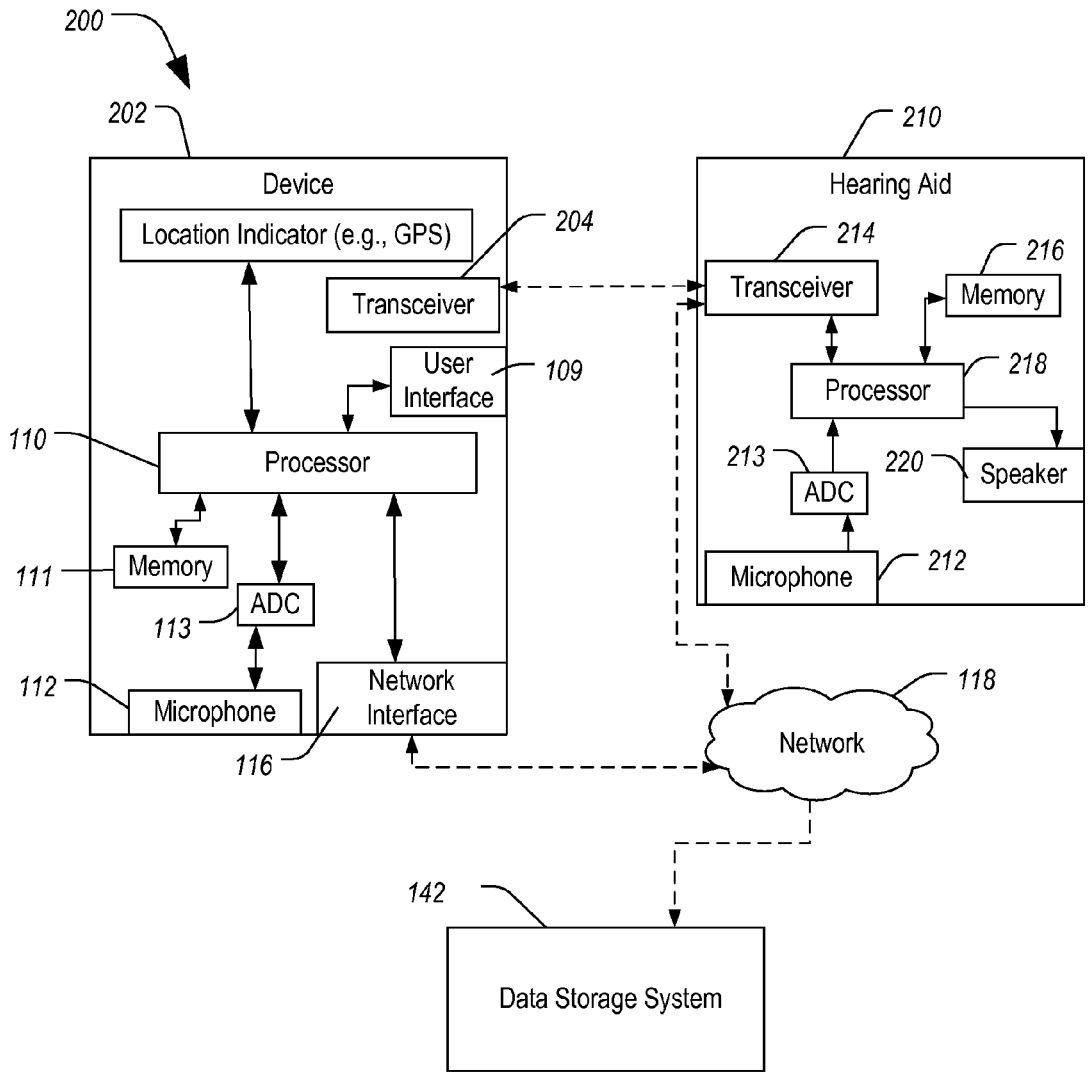
FIG. 2 is a block diagram of a second embodiment of a system for collecting acoustic data.

FIG. 2 is a block diagram of an embodiment of a system 200 for collecting acoustic data. System 200 comprises hearing aid 210, computing device 202, network 118, and data storage system 142. Computing device 202 is the same as computing device 102 in FIG. 1, except that computing device 202 includes a transceiver 204, which is configured to communicate with hearing aid 210 through a wired or wireless communication channel.

Hearing aid 210 includes a transceiver 214, which is connected to a processor 218. Processor 218 is connected to memory 216 and to a speaker 220. Further, processor 218 is connected to an output of ADC 213, which has an input connected to an output of microphone 212. Microphone 212 converts sound to an electrical signal, which is digitized by ADC 213 and provided to processor 218. Processor 218 processes the electrical signal according to a hearing aid profile stored in memory 216 that is configured to shape the electrical signal to produce a modulated output signal, which compensates for a user's hearing impairment. Processor 218 provides the modulated output signal to speaker 220 for reproduction at or within the user's ear. Further, processor 218 may provide one or more samples to transceiver 214 for communication to device 202 for processing and transmission as acoustic data to data storage system 142. Alternatively, transceiver 214 may be configured to communicate with network 118 for transmitting the acoustic data to data storage system 142.

In operation, hearing aid 210 can collect acoustic samples, process the acoustic samples into acoustic data, and send the acoustic data to data storage system 142 through computing device 202 or via transceiver 214 through network 118. In one embodiment, processor 110 receives a trigger (as discussed above) and sends instructions to hearing aid 210 through the communication channel, instructing hearing aid 210 to collect the acoustic data. In response to receiving the instructions, processor 218 controls microphone 212 to collect the acoustic samples. Processor 218 transmits the acoustic samples and/or data related thereto to computing device 202 through the communication channel. Processor 110 can process the acoustic samples to produce the acoustic data and forward the acoustic data to data storage system 142 as described above with respect to FIG. 1.

In another embodiment, hearing aid 210 includes a processor that is configured to process the acoustic samples to produce the acoustic data prior to forwarding the acoustic data to computing device 202. In this example, hearing aid 210 receives the trigger (or generates it internally according to processing instructions executed on the processor), collects the acoustic data, and processes the data. Hearing aid 210 then transmits the acoustic data to computing device 202 through the communication channel. Computing device 202 receives the acoustic data at transceiver 204 and relays the encoded acoustic data to data storage system 142 through network 118. In an example, computing device 202 adds location data and a date/time stamp to the acoustic data before encoding the data for transmission to data storage system 142.

While, FIGS. 1 and 2 show examples of implementations of a location-based sound profiling system, there are many possible implementations. Data storage system 142 is configured to receive such acoustic data from a variety of sources. Additionally, such acoustic data may be free from indicia related to the source, allowing for anonymous collection of such acoustic data. One possible method of compiling such location-based acoustic information is described below with respect to FIG. 3.

Figure 3:
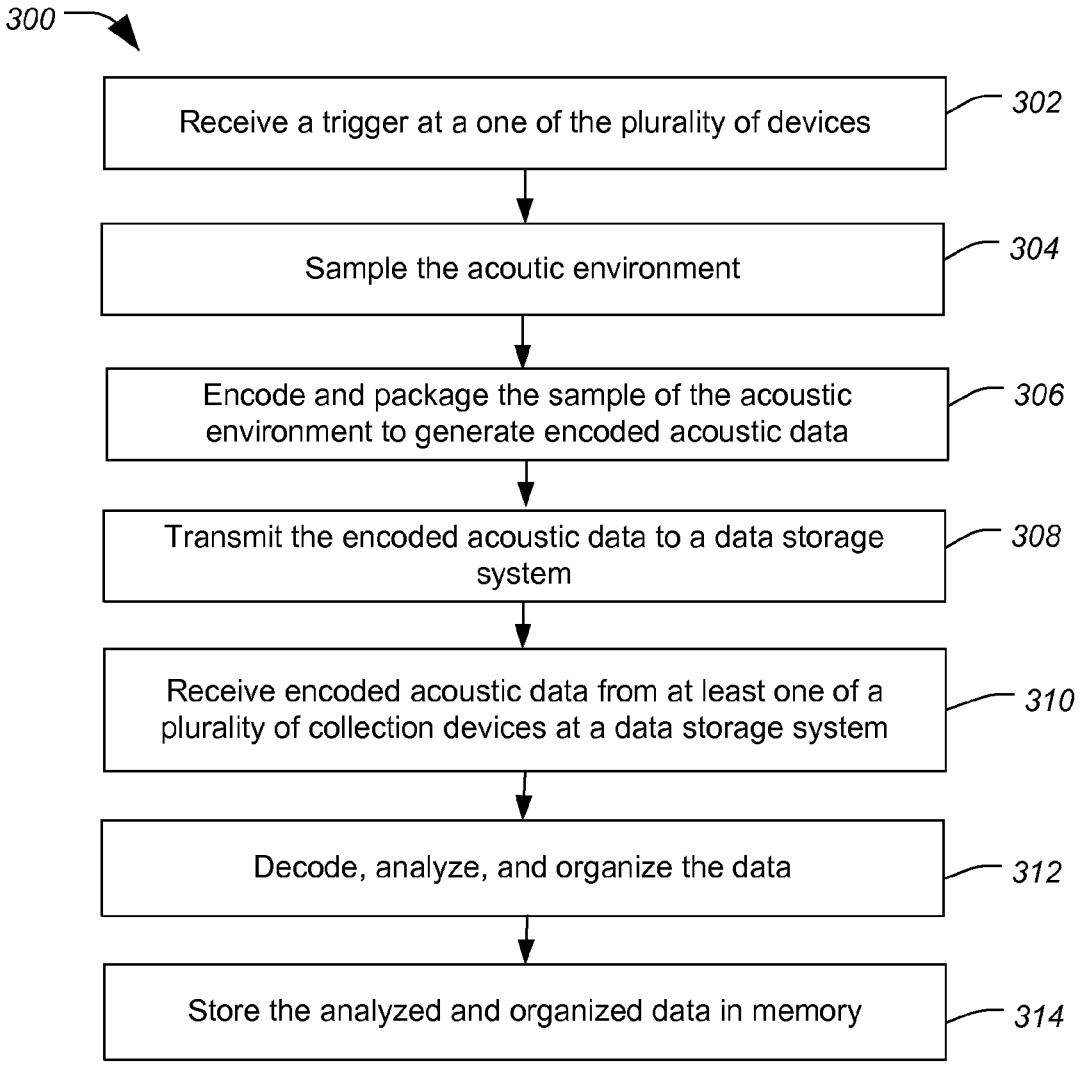
FIG. 3 is a flow diagram of a method of collecting acoustic data.

FIG. 3 is a flow diagram of an embodiment of a method 300 for collecting acoustic environmental data. In method 300, blocks 302, 304, 306, and 308 represent actions performed by one or more devices, such as hearing aid 210 and/or computing device 102. Further, blocks 310 and sequence represent actions performed by a centralized system, such as data storage system 142. At 302, one of the plurality of devices receives a trigger. As described above in FIGS. 1 and 2, the trigger can be a command or instruction for causing the receiving device to sample the acoustic environment. The device can be a computing device, such as devices 102 and 202, a hearing aid, another device, or a system including computing device 202 and/or hearing aid 210. Proceeding to 304, the device samples the acoustic environment. The device uses a microphone, for example, to convert sounds into acoustic samples for processing by processor 110. In some instances, where the device is a hearing aid for example, the device may communicate the acoustic samples to a processor of another device, such as computing device 202, for processing.

At 306, processor 110 encodes and packages the acoustic samples received to produce encoded acoustic data. In some instances, the device may transmit such data to an intermediary, such as computing device 202, for relaying the acoustic data to the data storage system 142. Such encoding and packaging may include stripping identifying information from the samples so that the samples cannot be traced back to their source to protect private information of the individual user. Further, such encoding and packaging of the acoustic data for transmission can include adding data/time information (e.g., a date/time stamp) and location data associated with the sample. Once the acoustic samples are encoded and packaged for transmission, processor 110 provides the encoded acoustic data to network interface 116. Advancing to 308, the device transmits the encoded acoustic data to data storage system 142. Network interface 116 transmits the encoded acoustic data through network 118.

With respect to method 300, the following blocks represent actions performed by a data storage system, such as data storage system 142. Proceeding to 310, a data storage system receives the encoded acoustic data from at least one of the plurality of collection devices through the communication channel. In an example, the encoded data is received at network interface 144, which provides the encoded data to processor 146 and the method advances to 312. At 312, the processor decodes, analyzes, and organizes the encoded data. For example, once the encoded data is decoded, processor 146 may organize the data based on a number of factors to create a searchable database, which can be made accessible to hearing health professionals, which may be used to generate an acoustic environmental map, or which can be used to establish acoustic charts measuring acoustic data for particular geographical areas. In an example, the acoustic data may be processed and organized according to location, time, or other parameters, prior to storage in memory 148 to provide for a searchable, structured data source.

Advancing to 314, the analyzed and organized data are stored in memory 148. Once the data is analyzed, organized, and stored, the processed data can be accessed to provide actual sample data for use in programming a hearing aid for an individual user, for example, based on the user's geographic location. Further, such information can be used to inform the public about acoustic environments. In one particular instance, such sound sample information can be processed to normalize the data and can be pieced together with sound samples from various sources to produce an acoustic map that can be layered onto a geographical map to provide a geographical representation of sound environments. Other possible uses of the accumulated acoustic data are also contemplated.

In conjunction with the devices, systems, and methods disclosed herein with respect to FIGS. 1-3, a device includes an input for receiving data related to a sound and a processor coupled to the input for processing the data to produce acoustic data. The device further includes a transceiver coupled to the processor that is configured to communicatively connect to a communications network, such as the Internet or a cellular network. In an example, the processor receives the data, processes the data to produce acoustic data (including, for example, frequency data, amplitude data, time/date data, location data, or any combination thereof), and sends the acoustic data to a data storage device through a network. The data storage device stores the acoustic data in a memory, which may be accessible to, for example, a hearing health professional for providing acoustic samples that can be used to produce hearing aid profiles for particular users. Further, such information can be used to assemble an acoustic profile of a location, which can be used to generate location-specific audio filters for use in hearing aids, for example.

Although the present invention has been described with reference to preferred embodiments, workers skilled in the art will recognize that changes may be made in form and detail without departing from the scope of the invention.

What is claimed is:

1. A device, comprising:

a network interface configurable to communicate with a communication network;

a microphone configured to convert sounds captured from an environment around the device into an electrical signal;

a processor coupled to the microphone and the network interface; and a memory storing instructions that, when executed by the processor, cause the processor to:

provide an opt-in privacy setting, wherein the opt-in privacy setting enables the processor to remove identifying data specific to the device and encrypt acoustic data for transmission;

receive a selection to activate the opt-in privacy setting;

execute a trigger in response to detecting a selection of a hearing aid configuration, wherein the trigger causes the microphone to capture sounds from the environment around the device;

process the electrical signal to generate acoustic data representative of the sounds captured from the environment around the device based on the electrical signal;

remove identifying data specific to the device;

encrypt the acoustic data for transmission; and provide the encrypted acoustic data representative of the sounds captured from the environment around the device to the network interface for transmission to a data storage device.

2. The device of claim 1, further comprising:

a speaker coupled to the processor;

wherein the processor is configured to apply a hearing aid profile to the electrical signal to produce a modulated output signal compensated for hearing impairments of a user; and wherein the speaker is configured to reproduce the modulated output signal as an audible sound.

3. The device of claim 2, wherein the acoustic data comprises at least one of hearing aid configuration data and a hearing aid profile.

4. The device of claim 1, further comprising a user interface for displaying information and receiving user input.

5. The device of claim 1, wherein the device comprises a cell phone.

6. The device of claim 1, wherein the device comprises a computing device.

7. The device of claim 1, wherein the device further comprises a transceiver configurable to communicate with a hearing aid.

8. The device of claim 1, further comprising:

a location indicator coupled to the processor and configured to provide location data to the processor; and wherein the memory further comprises instructions that, when executed by the processor, cause the processor to combine the location data with data derived from the electrical signal to produce the acoustic data.

9. The device of claim 1, wherein the instructions, when executed by the processor, cause the processor to generate a plurality of triggers, and wherein each of the plurality of triggers causes the microphone to capture sound from the environment for a predetermined period of time.

10. A non-transitory computer-readable storage medium storing instructions that, when executed by a processor, cause the processor to perform operations for gathering acoustic data, the operations comprising:

receiving a sound sample with a device;

storing a location indicator related to the sound sample;

storing a time stamp related to the sound sample, the sound sample representative of an acoustic environment at a location determined from the location indicator and at a time determined from the time stamp;

processing the sound sample to generate acoustic data related to the location and the time;

providing an opt-in privacy setting, wherein the opt-in privacy setting enables a processor to remove identifying data specific to the device and encrypt acoustic data for transmission;

receiving a selection to activate the opt-in privacy setting;

removing identifying data specific to the device;

encrypting the acoustic data for transmission; and transmitting the encrypted acoustic data through a communication network.

11. The non-transitory computer-readable medium of claim 10, wherein the device is a hearing aid.

12. The non-transitory computer-readable medium of claim 10, wherein the location indicator comprises a global positioning system (GPS) position.

13. The non-transitory computer-readable medium of claim 10, wherein the time stamp includes a date stamp.

14. A method comprising:

receiving a trigger at a device to capture sound samples of an acoustic environment, the trigger generated in response to detecting a selection of a hearing aid configuration;

sampling the acoustic environment using a microphone to produce an electrical signal associated with the acoustic environment;

processing the electrical signals to produce acoustic data representative of the acoustic environment;

providing an opt-in privacy setting, wherein the opt-in privacy setting enables a processor to remove identifying data specific to the device and encrypt acoustic data for transmission;

receiving a selection to activate the opt-in privacy setting;

removing identifying data specific to the device;

encrypting the acoustic data for transmission; and transmitting the encrypted acoustic data representative of the acoustic environment to a data storage device through a communications network.

15. The method of claim 14, wherein processing the electrical signal comprises:

deriving frequency and amplitude data from the electrical signal; and combining the frequency and amplitude data with other data to produce the acoustic data.

16. The method of claim 15, wherein the other data comprises location data.

17. The method of claim 15, wherein the other data comprises a date and time stamp.

18. The non-transitory computer-readable medium of claim 10 wherein the operations further comprise:

providing an acoustical map representative of the acoustic data at the time and the location, and wherein the acoustical map is overlaid on a geographic map.

19. The non-transitory computer-readable medium of claim 10 wherein the operations further comprise:

receiving inputs to provide a hearing aid profile at the device based on the acoustical map; and providing the hearing aid profile to a hearing aid via the communication network.

20. The non-transitory computer-readable medium of claim 10 wherein the operations further comprise transmitting the programming instructions to the hearing aid.

21. The non-transitory computer-readable medium of claim 10 wherein the device is a cell phone.

* * * * *